US007221898B2

(12) United States Patent
Pozniakas

(10) Patent No.: US 7,221,898 B2
(45) Date of Patent: May 22, 2007

(54) CHARGED PARTICLES CLEANING APPARATUS HAVING A BIASED MANIFOLD

(75) Inventor: Robert S. Pozniakas, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/179,412

(22) Filed: Jul. 12, 2005

(65) Prior Publication Data

US 2007/0014607 A1 Jan. 18, 2007

(51) Int. Cl.
*G03G 21/00* (2006.01)
*G03G 21/20* (2006.01)

(52) U.S. Cl. ..... 399/355; 399/354; 399/353; 399/92; 399/93

(58) Field of Classification Search ..... 399/355, 399/354, 353, 92, 93
See application file for complete search history.

(56) References Cited

U.S. PATENT DOCUMENTS 5,214,479 A 5/1993 Lindblad et al.
5,724,640 A 3/1998 Thayer
5,732,320 A 3/1998 Domagall et al.
6,282,401 B1 8/2001 Proulx et al.

FOREIGN PATENT DOCUMENTS

JP 58023075 A * 2/1983
JP 60179773 A * 9/1985

* cited by examiner

*Primary Examiner*—David M. Gray
*Assistant Examiner*—Joseph S. Wong
(74) *Attorney, Agent, or Firm*—Tallam I. Nguti

(57) ABSTRACT

A charged particles cleaning apparatus for cleaning and removing charged particles from a surface includes (a) a housing; (b) a surface scrubbing member mounted within the housing for contacting the surface and frictionally removing charged particles therefrom; (c) an air blower for pulling an air stream out of the housing; (d) a manifold connecting the housing to the air blower for directing the air stream and charged particles therein out of the housing, the manifold including manifold walls having inside surfaces defining a duct passage for the air stream; and (e) at least one biasing source connected to the inside surfaces of the manifold walls for biasing the inside surfaces to prevent build up of charged particles on the inside surfaces, thereby reducing costs of periodic cleaning of the manifold walls.

17 Claims, 3 Drawing Sheets

CHARGED PARTICLES CLEANING APPARATUS HAVING A BIASED MANIFOLD

The present disclosure relates generally to electrostatographic reproduction machines, and more particularly, concerns such a machine including a charged-particles cleaning apparatus having a cost reducing and life-extending biased manifold.

In a typical toner image reproduction machine, for example an electrostatographic printing process machine, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a charged-developer material into contact with it. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrostatographic printing machine. With the advent of multicolor electrophotography, it is desirable to use an architecture that comprises a plurality of image forming stations. One example of the plural image forming station architecture utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color.

It has been found that image-on-image processes, for example, create very high toner densities on the photoconductive or photoreceptor surface. In some machines using toner particles with toner additives in similar multi-color processes, the additional use of control patches, and engagements in component-disturbing activities such as recovery from paper jams, together create conditions that make cleaning or removal of residual toner particles from the imaging region as well as elsewhere very challenging for ordinary conventional cleaning apparatus. The situation is made worse when such conditions are combined with higher process speeds, and demands for higher print quality, longer component lives and higher machine reliability.

The following references disclose examples of existing cleaning devices for cleaning photoreceptor surfaces. U.S. Pat. No. 5,214,479 issued May 25, 1993 and entitled "BTR AIR CLEANER WITH BIASED SHIMS" discloses apparatus for cleaning residual toner and paper fiber residue from a biased transfer roll (BTR) in an electrophotographic apparatus using high velocity air and substantially contactless flexible biased conductive shims. The high velocity air flow between the BTR and two thin conductive flex-shims is created by means of a blower that evacuates the air in the cleaner housing vacuum chamber. The high velocity air, in combination with the electrically biased BTR and flex-shims, removes residue from the BTR surface and carries it into the vacuum chamber and deposits the residue in a filter bag. The BTR biased shim cleaner system is low cost, efficient and significantly smaller than current BTR cleaning devices.

U.S. Pat. No. 5,732,320 issued Mar. 24, 1998 and entitled "CLEANING BLADE" discloses a spots cleaning blade for use in a cleaning apparatus in an imaging apparatus for cleaning agglomerate particles from an imaging surface, the spots cleaning blade comprising a polyether urethane and having a high hardness and low coefficient of friction.

U.S. Pat. No. 5,724,640 issued Mar. 3, 1998 and entitled "FLOATING BACKER AND MOUNT FOR CLEANING BLADES AND SPOTS BLADES ON BELT IMAGING SURFACES" discloses apparatus for cleaning particles from a surface using a floating backer and cleaning or spots blade mounted to allow freedom to follow the location of the imaging surface. The cleaning or spots blade controls tolerances when the blade and the floating backer are mounted to a frame pivoted from a fixed photoreceptor backer. This freedom allows a minimization of the tolerances in blade load against the surface or photoreceptor, the blade angle to the photoreceptor and in the location of the blade relative to the backer. This floating backer and blade mount also minimizes the wrap required on the photoreceptor backers adjacent to the blade.

U.S. Pat. No. 6,282,401 issued Aug. 28, 2001 and entitled "HARD CLEANING BLADE FOR CLEANING AN IMAGING MEMBER" discloses a relatively hard cleaning blade for use in a cleaning apparatus in an imaging apparatus for cleaning residual toner particles, including dry and liquid ink toners and carriers, from an imaging surface, the cleaning blade having a material having a hardness of from about 86 to about 120 Shore A.

As disclosed in the above examples, the uses of existing cleaning devices such as cleaning brushes and elastomeric blades for cleaning such surfaces are well known. Typically, residual toner and other particles removed from the photoreceptor surface by a cleaning member must be carried or taken away for example by an auger 342 or an air sucking system. Air sucking systems ordinarily include a manifold or duct device for directing such removed and air born particles to a collection point.

It has been found that toner and free toner additives tend to deposit on the manifold walls particularly on the wall of the inside radius of a manifold turn. Thus such deposits of toner and toner additives have been found to be much worse toward the inside of a turn in the manifold or duct. In general, the very small sized toner additives require extremely high air flow velocity to remove them from a surface they have contacted. Overall, such deposits ordinarily would eventually build up and clog the air passages thus reducing the air stream flow through the manifold and through the cleaner brush inputting into the manifold. Clogs of this nature typically require costly downtime for removal and cleaning of the manifold. Attempts to continue operation by increasing blower power and capacity under such clogged have been found to result in increased noise and cost.

In accordance with one aspect of the present disclosure, there is provided a charged particles cleaning apparatus for cleaning and removing charged particles from a surface includes (a) a housing; (b) a surface scrubbing member mounted within the housing for contacting the surface and frictionally removing charged particles therefrom; (c) an air blower for pulling an air stream out of the housing; (d) a manifold connecting the housing to the air blower for directing the air stream and charged particles therein out of the housing, the manifold including manifold walls having inside surfaces defining a duct passage for the air stream; and (e) at least one biasing source connected to the inside surfaces of the manifold walls for biasing the inside surfaces to prevent build up of charged particles on the inside surfaces, thereby reducing costs of periodic cleaning of the manifold walls.

The foregoing and other features of the instant disclosure will be apparent and easily understood from a further reading of the specification, claims and by reference to the accompanying drawings in that:

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
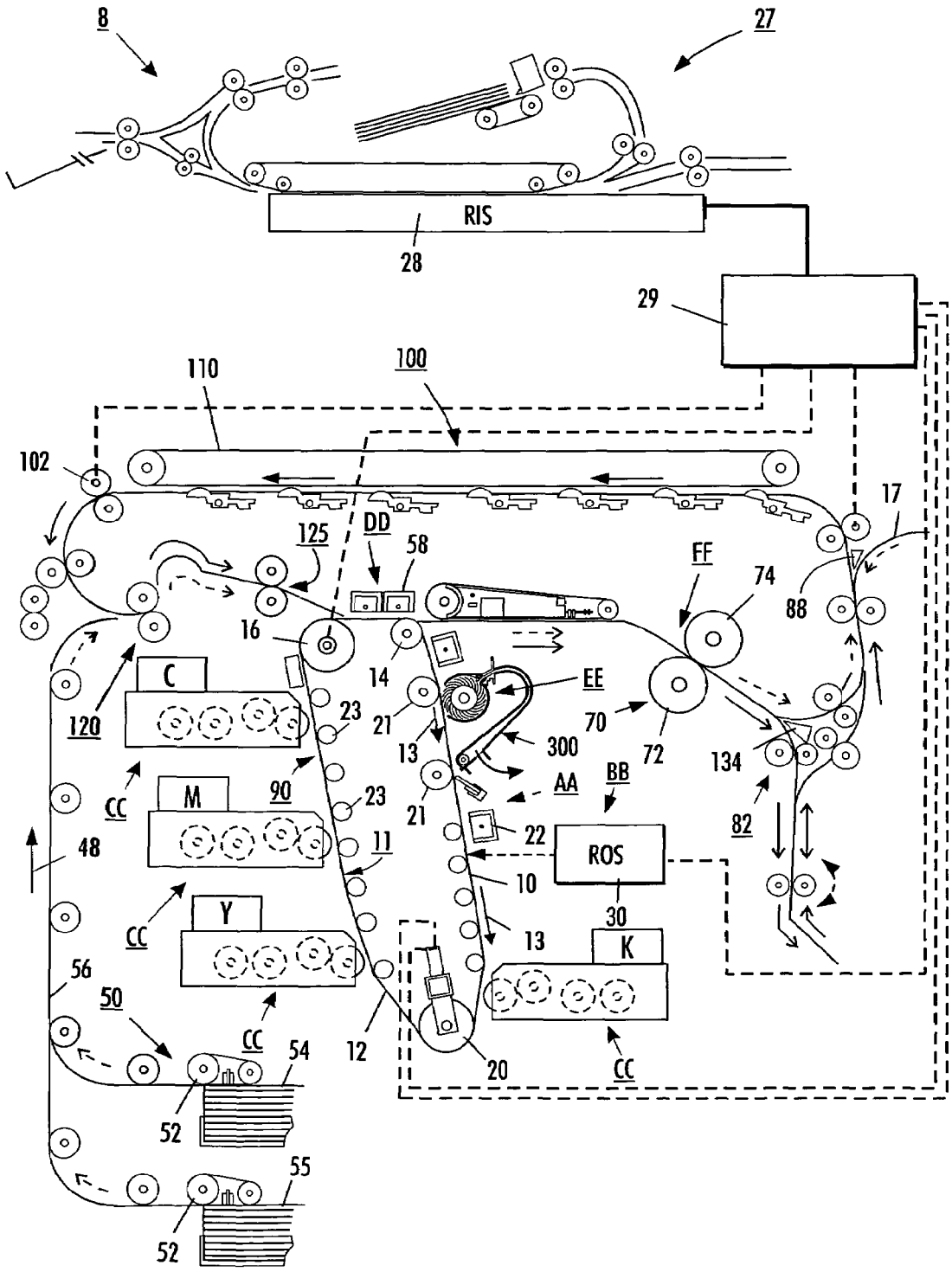
FIG. 1 is a schematic elevational view of an exemplary electrostatographic reproduction machine including the charged particles cleaning device and biased manifold of the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes a fuser assembly indicated generally by the reference numeral 70 that permanently affixes the transferred toner power image to the copy sheet. Preferably, fuser assembly 70 includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent is transferred to a donor roll (not shown) and then to the fuser roll 72.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, the sheet when to be directed into the duplex path 100, is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where the sheet is inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom at cleaning station EE in accordance with the present disclosure. Cleaning station EE as illustrated includes a charged particles cleaning apparatus 300 for removing and taking away charged from the photoreceptor surface 12.

Figure 2:
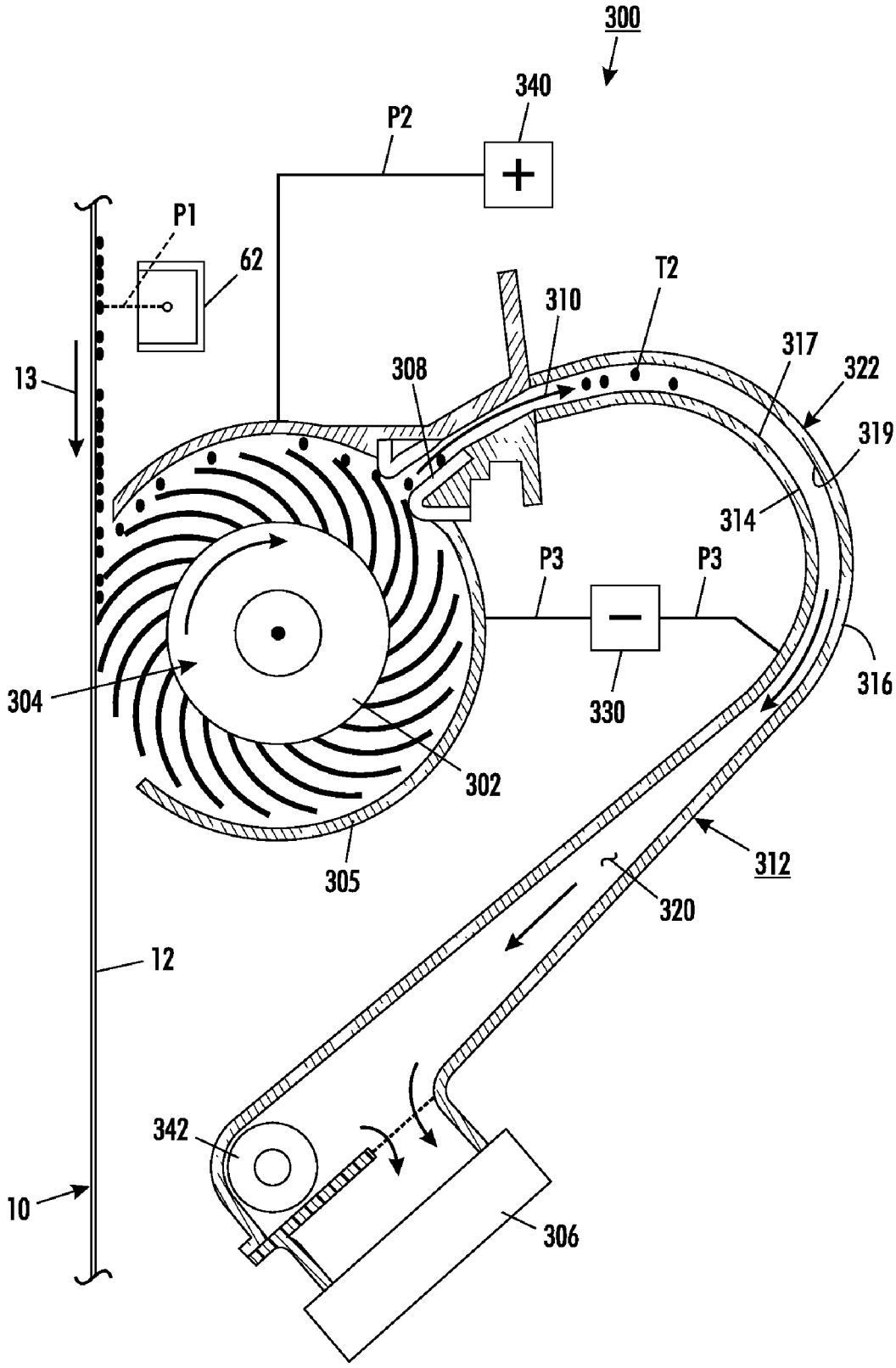
FIG. 2 is an enlarged schematic of a single brush embodiment of the charged particles cleaning device and biased manifold of the present disclosure.

Referring now to FIGS. 1-2, the charged particles cleaning apparatus 300 is suitable for cleaning and removing charged particles T1 from a surface such as the photoreceptor surface 12. As shown, it is comprised of (a) a housing; (b) a surface scrubbing member 304 mounted within the housing for contacting the surface 12 and frictionally and/or electrostatically removing the charged particles T1 therefrom; (c) an air blower 306 for pulling an air stream 310 out of the housing 305; (d) a manifold 312 manifold including manifold walls 314, 316 having inside surfaces 317, 319 defining a duct passage 320 for the air stream 310, the manifold 312 as such connecting the housing 305 to the air blower 306 for directing the air stream 310 and charged particles T2 therein out of the housing; and (e) at least one biasing source 330, 340 connected to the inside surfaces 317, 319 of the manifold walls 314, 316 for biasing the inside surfaces so as to prevent build up of charged particles on such inside surfaces, thereby reducing costs of periodic cleaning of the manifold walls.

Figure 3:
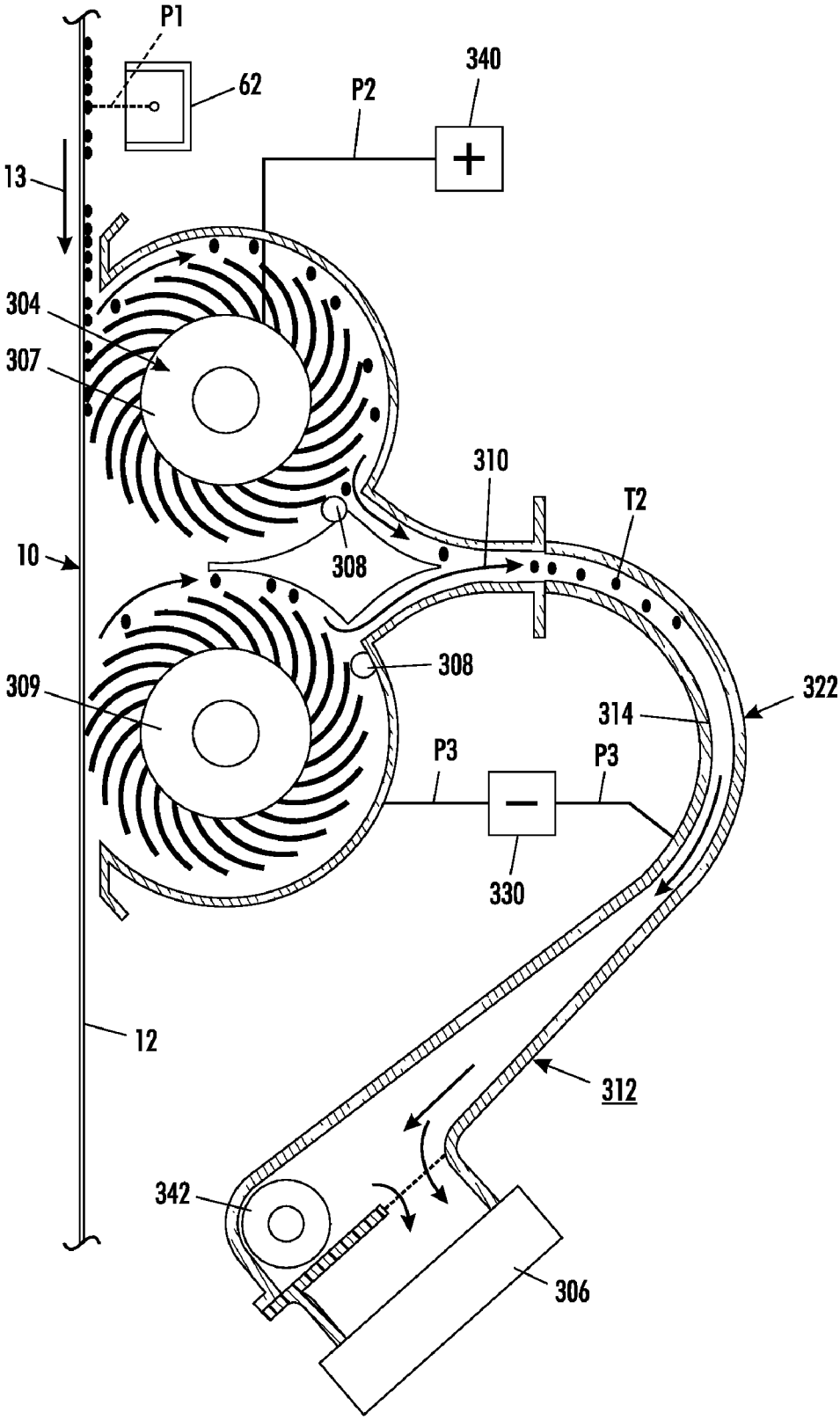
FIG. 3 is an enlarged schematic of a two brushes embodiment of the charged particles cleaning device and biased manifold of the present disclosure.

As illustrated, the surface scrubbing member 304 can comprise a cleaning blade as is well known, or a rotatable fiber brush 302. Although only one brush is shown, a pair of rotatable fiber brushes 307, 309 (FIG. 3) will work equally well. The duct passage 320 includes a turn 322 that has an inner wall 314 with an inner radius R1, and an outer wall 316 with an outer radius R2. As further shown, the at least one biasing source 330, 340 can comprise a direct current (DC) biasing source 330 or an alternating current (AC) biasing source 340.

In an alternative as illustrated, the at least one biasing source 330, 340 comprises both the biasing source 330 as a first source, and the biasing source 340 as a second and different biasing source. As shown, first biasing source 330 is connected to the inner wall 314 for biasing such inner wall of the turn 322, and the second and different biasing source 340 is connected to the outer wall 316 for biasing such outer wall of the turn. The first biasing source 330 for example is a DC biasing source, and the second and different biasing source 340 can be an AC biasing source.

As also shown, the charged particles cleaning apparatus 300 further includes a pre-clean charging device 62 for charging the particles T1 on the photoreceptor surface 12 to a predetermined first polarity P1, for example, a negative polarity. In one embodiment, the pre-clean charging device 62 and the at least one biasing source 330, 340 have the same polarity P1. In another, the pre-clean charging device 62 and the at least one biasing source 330, 340 have a first polarity P1 and the surface scrubbing member 304 has a second and opposite polarity P2.

As pointed out above, it has been found that toner and free toner additives tend to deposit on the manifold walls 314, 316, particularly on the inner wall 314 of the inside radius of a manifold turn 322. Thus such deposits of toner and toner additives have been found to be much worse toward the inside of a turn 322 in the manifold or duct. In general, the very small sized toner additives require extremely high airflow velocity to remove them from a surface they have contacted. Overall, such deposits ordinarily would eventually build up and clog the air passage 320, thus reducing the air stream 310 flow through the manifold 312 and through the cleaner brush 305 inputting into the manifold. Clogs of this nature typically require costly downtime for removal and cleaning of the manifold. Attempts to continue operation by increasing blower power and capacity under such clogged have been found to result in increased noise and cost.

One clear benefit from using the charged particles cleaning apparatus 300 above is that the interval or time between removal and de-clogging service calls on the manifold 312 can be extended. This is because the charged particles cleaning apparatus 300 applies the electric fields of the biasing sources 330, 340 to repel charged particles away from the biased inside walls or surfaces 317, 319 of the manifold back into the air stream 310 flowing therethrough. As disclosed above, a DC field on such wall 314 from the Dc biasing source 330 and of the same polarity as that on the charged particles, effectively causes such wall or surface 314, 317 to repel such particles, thereby protecting surfaces from deposits and any eventual build up.

In operation, residual toner particles on the photoreceptor surface 12 are charged by the preclean charging device 62 for example a corotron, in order to enable stronger attraction of such particles to the oppositely biased electrostatic cleaner brush 302. For example, the polarity P1 of the preclean charge can be negative while that, P2, of the bias on the brush 305 is positive. The negative charge on the residual toner particles however is largely still present throughout the process of such particles being pickup by the brush, being removed or detoned at the flicker bar 308 from the brush, and while being carried by the air stream 310 through the manifold or duct passage 320.

Ordinarily, the negative charge still present in such particles is what creates an electrostatic attraction force between such particles and the manifold walls 314, 316, thus resulting in the undesirable deposition and build up of such particles on the walls 314, 316 as described above. A hypothesis for the worse deposition of additives at the inside of a turn is that its due to a combination of lower flow velocity and lack of impingement of the larger toner particles against the wall, that tends to scour the outside wall. Since the deposits are several times worse along the inside of turns, the DC biasing source 330 inducing a DC field of the same polarity (negative) as the particles on the inner wall or surface 314 functions to effectively repel the negatively charged particles away from such inside or inner wall or surface 314.

For example, a significant reduction of over 75% in deposits was verified with a DC biasing source 330 inducing a DC field on the manifold of a charged particles cleaning apparatus in one machine. The result was only a dusting of toner particles on either the outer or inner manifold turn surfaces in the critical throat area (narrowest part) of the manifold when compared to around 2 mm in a baseline test without such manifold biasing. The E field used was only 167 V/Mm. The total weight gain of the manifold after a test run of 500 Kp, dropped from 35 to 20 gm (a 43% decrease), indicative of the reduction in deposits and build up of toner particles on the manifold walls. Some deposits were still evident in the narrow areas behind the flicker bar gap support struts. This concept is well suited for use on charged particles cleaning apparatus having relatively flat manifolds/ducts since a fairly low voltage is required.

The prototype manifold for the above test was made by painting the inside surfaces or walls of the plastic manifold of the cleaning apparatus with highly conductive Ni paint. The edges were masked in order to allow different voltage polarities on each part (inner and outer) surfaces of the turn or throat region. The lower extrusion was covered with insulative tape since the voltage difference to the brush was 500 V, and the brush outer diameter and cleaner housing are in line-line. Ordinarily both the positive and negative voltages required for biasing in accordance with the present disclosure would already be available on a typical electrostatographic machine.

As can be seen, there has been provided a charged particles cleaning apparatus for cleaning and removing charged particles from a surface includes (a) a housing; (b) a surface scrubbing member mounted within the housing for contacting the surface and frictionally removing charged particles therefrom; (c) an air blower for pulling an air stream out of the housing; (d) a manifold connecting the housing to the air blower for directing the air stream and charged particles therein out of the housing, the manifold including manifold walls having inside surfaces defining a duct passage for the air stream; and (e) at least one biasing source connected to the inside surfaces of the manifold walls for biasing the inside surfaces to prevent build up of charged particles on the inside surfaces, thereby reducing costs of periodic cleaning of the manifold walls.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A charged particles cleaning apparatus for cleaning and removing charged particles from a surface, said charged particles cleaning apparatus comprising:

(a) a housing;

(b) a surface scrubbing member mounted within said housing for contacting said surface and removing charged particles therefrom;

(c) an air blower for pulling an air stream out of said housing;

(d) a manifold connecting said housing to said air blower for directing said air stream and charged particles therein out of said housing, said manifold including manifold walls having inside surfaces defining a duct passage for said air stream (e) at least one biasing source connected to said inside surfaces of said manifold walls for biasing said inside surfaces to prevent build up of charged particles on said inside surfaces, thereby reducing costs of periodic cleaning of said manifold walls; and (f) a pre-clean charging device for charging particles on said surface to a predetermined polarity, said pre-clean charging device and said at least one biasing source having a same polarity.

2. The charged particles cleaning apparatus of claim 1, wherein said surface scrubbing member comprises a rotatable fiber brush.

3. The charged particles cleaning apparatus of claim 1, wherein said surface scrubbing member comprises a pair of rotatable fiber brushes.

4. The charged particles cleaning apparatus of claim 1, wherein said at least one biasing source comprises a direct current source.

5. The charged particles cleaning apparatus of claim 1, wherein said at least one biasing source comprises an alternating current source.

6. The charged particles cleaning apparatus of claim 1, wherein said at least one biasing source comprises a direct current source and an alternating current source.

7. The charged particles cleaning apparatus of claim 1, wherein said pre-clean charging device and said at least one biasing source have a first polarity and said surface scrubbing member has a second and opposite polarity.

8. The charged particles cleaning apparatus of claim 1, wherein said duct passage includes a turn having an inner radius and an outer radius.

9. The charged particles cleaning apparatus of claim 5, wherein said at least one biasing source comprises a first biasing source for biasing said inner radius of said turn and a second and different biasing source for biasing said outer radius of said turn.

10. An electrostatographic reproduction machine comprising:

(a) a movable toner image bearing member having an image bearing surface and a direction of movement;

(b) toner image forming devices mounted along a path of movement of said toner image bearing surface for forming a toner image on said movable toner image bearing surface;

(c) transfer means for transferring said toner image from said movable toner image bearing surface onto a substrate; and (d) a charged toner particles cleaning apparatus for cleaning and removing charged toner particles from said movable toner image bearing surface, said charged toner particles cleaning apparatus comprising:

(i) a housing;

(ii) a surface scrubbing member mounted within said housing for contacting said surface and removing charged toner particles therefrom;

(iii) an air blower for pulling an air stream out of said housing;

(iv) a manifold connecting said housing to said air blower for directing said air stream and charged toner particles therein out of said housing, said manifold including manifold walls having inside surfaces defining a duct passage for said air stream;

(v) at least one biasing source connected to said inside surfaces of said manifold walls for biasing said inside surfaces to prevent build up of charged toner particles on said inside surfaces, thereby reducing costs of periodic cleaning of said manifold; and (vi) a pre-clean charging device for charging particles on said surface to a predetermined polarity, said pre-clean charging device and said at least one biasing source having a same polarity.

11. The electrostatographic reproduction machine of claim 10, wherein said surface scrubbing member comprises a rotatable fiber brush.

12. The electrostatographic reproduction machine of claim 10, wherein said surface scrubbing member comprises a pair of rotatable fiber brushes.

13. The electrostatographic reproduction machine of claim 10, wherein said duct passage includes a turn having an inner radius and an outer radius.

14. The electrostatographic reproduction machine of claim 10, wherein said at least one biasing source comprises a direct current source.

15. The electrostatographic reproduction machine of claim 10, wherein said at least one biasing source comprises an alternating current source.

16. The electrostatographic reproduction machine of claim 10, wherein said at least one biasing source comprises a direct current source and an alternating current source.

17. The electrostatographic reproduction machine of claim 13, wherein said at least one biasing source comprises a first biasing source for biasing said inner radius of said turn and a second and different biasing source for biasing said outer radius of said turn.

* * * * *